United States Patent [19]

Petersen

[11] 4,012,611

[45] Mar. 15, 1977

[54] INERTIA SWITCH FOR ANTI-INTRUSION SENSING SYSTEMS

[75] Inventor: Christian C. Petersen, Westwood, Mass.

[73] Assignee: Cega, Inc., Boston, Mass.

[22] Filed: Mar. 3, 1975

[21] Appl. No.: 554,717

[52] U.S. Cl. ..... 200/61.45 R; 200/61.93; 335/205; 340/261

[51] Int. Cl.[2] ..... H01H 35/14; H01H 3/02; G08B 13/00

[58] Field of Search ..... 200/61.45–61.53, 200/61.93; 335/205; 340/261

[56] References Cited

UNITED STATES PATENTS

| | | | |
|---|---|---|---|
| 2,600,011 | 6/1952 | MacDonald et al. | 335/205 UX |
| 3,240,891 | 3/1966 | Bergey | 335/205 X |
| 3,249,713 | 5/1966 | Briggs | 335/205 |
| 3,330,016 | 7/1967 | Smith et al. | 335/205 X |
| 3,364,318 | 1/1968 | Bulliet | 335/205 UX |
| 3,596,021 | 7/1971 | Saul | 335/205 X |
| 3,601,729 | 8/1971 | Hierta | 335/205 |
| 3,748,415 | 7/1973 | Suzuki | 200/61.45 M |

FOREIGN PATENTS OR APPLICATIONS

| | | | |
|---|---|---|---|
| 1,524,095 | 4/1968 | France | 335/205 |

OTHER PUBLICATIONS

IBM Technical Disclosure Bulletin, V. O. Baker et al., "Low-Restriction Magnetic Flow Detector", vol. 11, No. 5, Oct. 1968, pp. 485, 486.

*Primary Examiner*—James R. Scott
*Attorney, Agent, or Firm*—Gerald L. Smith

[57] ABSTRACT

An intrusion alarm system incorporating an inertially responsive sensor arrangement which, in one embodiment, is provided as a body of mass suspended in pendulum fashion within a compact housing. A permanent bar magnet suspended therewith operates in conjunction with a manetically actuable switch to provide highly responsive and reliable sensing. A logic circuit provides a responsive, efficient pulsating alarm at dual frequencies optimized for human recognition, and a wireless magnetic remote disarm feature is provided.

10 Claims, 5 Drawing Figures

| | OPERATIONAL EVENT | GATE 80 LINE | | | GATE 78 LINE | | | GATE 76 LINE | | | GATE 74 LINE | | |
|---|---|---|---|---|---|---|---|---|---|---|---|---|---|
| | | 110 | 127 | 120 | 120 | 122 | 124 | 168 | 125 | 140 | 140 | 142 | 90 |
| 1 | SW 90 OPEN | 0 | 1 | 1 | 1 | 1 | 0 | 0 | 0 | 1 | 1 | 1 | 0 |
| 2 | SW 90 CLOSED ARM DELAY | 0 | 1 | 1 | 1 | 1 | 0 | 0 | 0 | 1 | 1 | 1 | 0 |
| 3 | ARM DELAY TERMINATION | 1 | 1 | 0 | 0 | 0 | 1 | 0 | 1 | 1 | 1 | 1 | 0 |
| 4 | ARM STATE B | 1 | 0 | 1 | 1 | 1 | 0 | 0 | 0 | 1 | 1 | 1 | 0 |
| 5 | ARM STATE A | 1 | 1 | 0 | 0 | 0 | 1 | 0 | 1 | 1 | 1 | 1 | 0 |
| 6 | SW 96 CLOSES AT STATE A | 1 | 1 | 0 | 0 | 0 | 1 | 1 | 1 | 0 | 0 | 0 | 1 |
| 7 | NET 62 OSC. DURING ARM STATE. A | 1 | 1 | 0 | 0 | 0 | 1 | 1 | 1 ↕ 0 | 0 ↕ 1 | 0 ↕ 1 | 0 ↕ 1 | 1 ↕ 0 |
| 8 | SW 90 OPENS ALARM ON | 1 | 1 | 0 | 0 | 0 | 1 | 1 | 1 ↕ 0 | 0 ↕ 1 | 0 ↕ 1 | 0 ↕ 1 | 1 ↕ 0 |
| 9 | TERMINATION OF ALARM ON DELAY PERIOD | 0 | 1 | 1 | 1 | 1 | 0 | 0 | 0 | 1 | 1 | 1 | 0 |

FIG. 5

INERTIA SWITCH FOR ANTI-INTRUSION SENSING SYSTEMS

BACKGROUND

Intrusion alarm systems have been devised under a broad number of schemes ranging from a dog that barks to ultra sophisticated systems designed for the protection of highly valuable property and produced at commensurate cost. When developing any of the intrusion alarm systems, the design approach generally is premised upon a need to apprise one entity of the passage and, preferably, attempted passage of another entity across a selected portal or vulnerable boundary.

The effectiveness of alarm designs has, to the present, been predicated upon the degree of sophistication, redundancy and/or number of separate components for the system contemplated. As alarm system designs have evolved for broadened, higher volume markets, their sophistication has given way to the extent that the sensing techniques utilized tend toward either the primitive or specialized-monofunctional and the logic of alarm control is reduced to affording the operator only few alternatively, i.e., the devices are more readily compromised. For instance, intrusion alarm devices intended for the relatively higher volume, popularly priced market have been seen to utilize simple switches mounted on the inside of a door to detect a successful unauthorized entry. Such sensing does not enjoy the capability for detecting and alerting to an attempted entry. For such a function, sensing components must be capable of exhibiting a very high degree of sensitivity to minor impact or similarly generated phenomena. Where an alarm is sounded at a mere attempted entry, the occupant within the area of alert is afforded the most valuable of surveilance service — the maximum available time interval to react to undertake protective measures.

To remain practical for higher volume markets, all such sensing devices should be easily calibrated to accommodate for an obviously broad range of sensing conditions. For instance, environmental "noise" conditions such as vibration and the like must be easily accounted for.

To simplify gaining access through a door protected by a simplified alarm, resort often is made to designs permitting an alarm delay following the triggering thereof. Thus, the operator may enter an alarm supervised door and, within the delay interval, disarm the alarm by throwing an arm switch or the like. Disadvantageously, such systems must permit full and successful unwarranted intrusion in accordance with their mandated logic.

Coded entrance arrangements heretofore have been proposed wherein a switching code or key system is mounted at the outer side of a protected door and which, when properly actuated, remotely disarm an alarm system. Such systems, however, generally are too complex for manufacture and installation under high volume procedures suited to achieve popular price levels. For instance, the devices may be required to be mounted and wired within a wall. Alternately, complexities are encountered in protecting otherwise exposed wiring extending from one side of a door to another.

Another aspect to be considered in providing a practical alarm system suited for popular utilization resides in the degree of installation expertise required of the purchaser. A most advantageous system is one which requires no mounting or assembly expertise whotsoever; for instance, no wiring or sensor switch installation, and equally simple access accessory installation.

SUMMARY

The present invention is addressed to a unique intrusion alarm sensing arrangement and system. Suited for a broad range of applications within the popularly priced market, the alarm system, including power supply, sensor, alarm and logic circuitry conveniently may be incorporated within a relatively small, lightweight singular housing readily mounted upon a door or portal selected for surveilance.

The sensor of the system responds inertially to an impact or motion generating phenomena imparted to the housing and is adjustable to exhibit a sensitivity which, for many installations, will react to a mere attempt at unauthorized entry. In its preferred embodyment, the sensor is formed including a body of predetermined mass suspended in pendulum-like fashion upon a rod or the like from a fixed point within the housing. However, other mounting arrangements for the mass are contemplated within the scope of the invention. A switch arrangement including a magnetically actuable switch and a magnet is mounted with respect to the end portion of the rod and a fixed, null location upon the housing. Any relative movement between these components will trip the system to sound an alarm. Preferably, a bar-type permanent magnet is fixed to the rod terminus, while a magnetically actuated reed relay switch is fixed to the housing.

Through the use of a switch arrangement incorporating a reed relay switch, a region of higher ferrous metal mass derived from overlapping switch contacts is provided on the housing toward which region the pendulum suspended magnet will automatically tend to null. This feature provides for convenient arming procedures and operation.

Another feature and object of the invention is to provide an alarm system including first and second oscillator networks, the first of which provides an output signal at a first frequency selected for optimum lower frequency human recognition. The second oscillator network provides an output at a second higher frequency, again selected for optimum human recognition. Activation of the second network serves to drive an alarm-transducer device at the second frequency and is dependent upon the derivation of a signal from the sensor as well as the presence of a selected output condition of the first oscillator network. Accordingly, a pulsating "on and off" alarm is sounded at optimized first and second frequencies. With the system, the sensor signal need only be transient.

As another feature, the system provides a delay arrangement which responds to the actuation of a system arm or enable switch. Operative in conjunction with the input stage of the noted first oscillator network, this feature provides an initial delay to permit the sensor to attain a null after arming, as well as to assure continued alarm activation for a predetermined interval following system firing.

Another feature of the invention provides with the noted second oscillator circuit an arrangement for detecting a transient sensor signal condition and retaining a select second network input for a short predetermined interval.

As another feature and object, the invention provides a remote disarm arrangement for the system requiring no external wiring and utilizing a simple permanent magnet.

Other objects of the invention will in part be obvious and will in part appear hereinafter.

The invention, accordingly, comprises the system and apparatus possessing the construction, combination of elements and arrangement of parts which are exemplified in the following detailed disclosure.

For a fuller understanding of the nature and objects of the invention, reference should be had to the following detailed description taken in conjunction with the accompanying drawings.

BRIEF DESCRIPTION OF THE DRAWINGS:

FIG. 5 is a truth table showing the performance of various components of FIG. 4 in the course of a series of operational events of the system.

DETAILED DESCRIPTION:

The basic unit of the intrusion alarm system of the invention is housed in a small, compactly structured container so dimensioned as to be conveniently attached to a portal intended for surveillance, i.e. a door, window or the like. This unit contains an inertially reactive sensing device, logic circuitry, alarm and power supply. Where desired, it may be combined with an entrance arrangement to permit subsequent externally devised access through an activated alarm guarded portal or door by utilization of a magnetic disarming technique.

Figure 1:
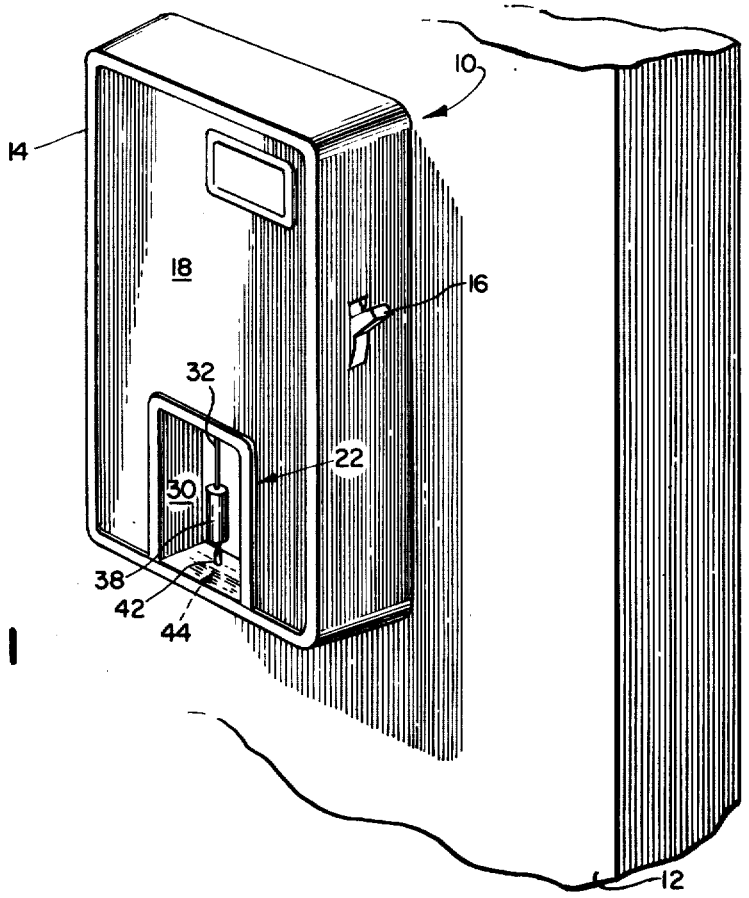
FIG. 1 is a perspective view of the basic alarm system unit of the invention as it is mounted upon a door.

Looking to FIG. 1, the basic intrusion alarm unit is revealed generally at 10 as it may be mounted, for example, upon a door 12. Unit 10 includes a box-like outer container 14, the rearward face of which is secured to an interior surface of door 12. Inasmuch as unit 10 may be fabricated of very light but sturdy materials, i.e. plastic, attachment to the door 12 may be conveniently provided by such materials as dual adhesively faced tape or the like positioned intermediate the rear surface of the unit and the door surface. In addition to integrated logic and alarm circuitry and, preferably, a typical primary battery power supply, container 14 supports an arm switch 16, a loudspeaker located within the unit for broadcast through surface area 18 thereof, and an inertially responsive sensor assembly, represented at 22. In general, the basic alarm unit 10 performs as follows: Upon positioning unit 10 at a location for detecting vibration, impact, accellerative motion or the like, for instance, upon the inside face of door 12, the operator throws arm or enable switch 16, which serves to activate an alarm-logic circuit only following a predetermined interval, for instance, 40 seconds. That arming interval permits any motion imparted to appropriate components of sensor assembly 22 during the arming procedure to be damped so as to gain a quiescent, null condition without tripping the alarm. This interval also will permit the operator to leave the area under surveillance through the door 12 upon which the unit 10 is mounted without causing it to prematurely trip. A slight motion or impact imparted to unit 10 from door 12 subsequent to the arming interval will activate the sensing system of the device to sound a loud pulsating alarm. After having been set off, the pulsating alarm can be turned off only following a predetermined interval, for instance, 60 seconds, from the throwing of arm or enable switch 16 to its initial off or disarm orientation. Should the sensing arrangement of the device not have been tripped, so throwing switch 16 to an off orientation will immediately deactivate the system.

The self-contained sensing arrangement 22 of the alarm system enjoys a particularly advantageous feature. For instance, through its inertially based performance, it is able to sense a very light impulse, thus being capable, in many instances, of forewarning the user thereof of a mere attempt at unauthorized entry. As a consequence, a highly valuable interval for protective reaction is availed the user. This feature is available, while, importantly, the sensitivity of the assembly 22 remains adjustable to accommodate for spurious vibration or motion, i.e. noise, which otherwise might occasion false alarms. Another important aspect of the sensor assembly 22 resides in its incorporation within unit 10, i.e., small, compact unit 10 is an entirely self-contained alarm system with no externally positioned components.

Figure 2:
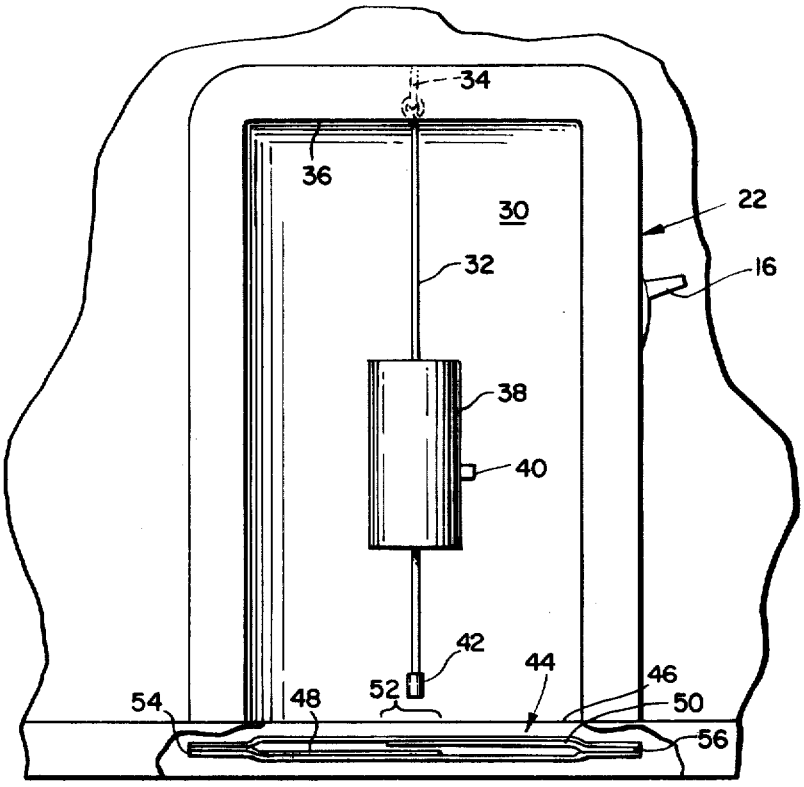
FIG. 2 is a fragmentary front view of the sensor arrangement of the invention.

Looking to FIG. 2, sensor assembly 22 is revealed in more detail as it is oriented in a null or quiescent status. The assembly is formed within a compartment or the like 30 of container 14 and includes a rod or suitable support 32 which is pivotally suspended therein. In this regard, the upper end of rod 32 is formed as a hook or the like and provides freely swinging pivotal attachment with a U-shaped connector 34 fixed within top wall 36 of compartment 30. Slideably mounted upon rod 32 is a body of predetermined mass present as a centrally bored cylincer 38 fashioned of any suitable stock material, for instance, aluminum, brass, or the like. Cylinder shaped mass 38 is radially bored and tapped to receive a set screw 40 which may be tightened against rod 32. With this arrangement, mass 38 may be positioned at any desired location along rod 32 and the assembly, thus far described, may be observed to represent a pendulum.

To the opposite, lower end of rod 32 is attached a small, somewhat cylindrically shaped, vertically oriented bar type permanent magnet 42. Magnet 42, thus suspended for movement in conjunction with rod 32, is located such that its lower polar end is situated at a given, relatively slight distance above a conventional magnetic reed switch 44. Switches as at 44 typically include a sealed tubular glass envelope 46 supporting therewithin, in cantilever fashion, two oppositely disposed, parallel and mutually spaced metal switch contacts as at 48 and 50. Present as low reluctance, ferromagnetic, slender flattened reeds, these contacts are oriented to overlap in spaced mutual relationship defining a small air gap at a centrally disposed region i.e. region for mutual contact 52 of switch 44. Accordingly, when caused to close or join, contacts 48 and 50 complete an electrical circuit through leads as at 54 and 56. Closure is carried out by causing contacts 48 and 50 to assume opposed magnetic polar states, i.e., north and south. In the presence of sufficient flux density, the attraction forces of the opposing magnetic poles overcome the reed stiffness causing them to flex toward each other to make contact.

Figure 3:
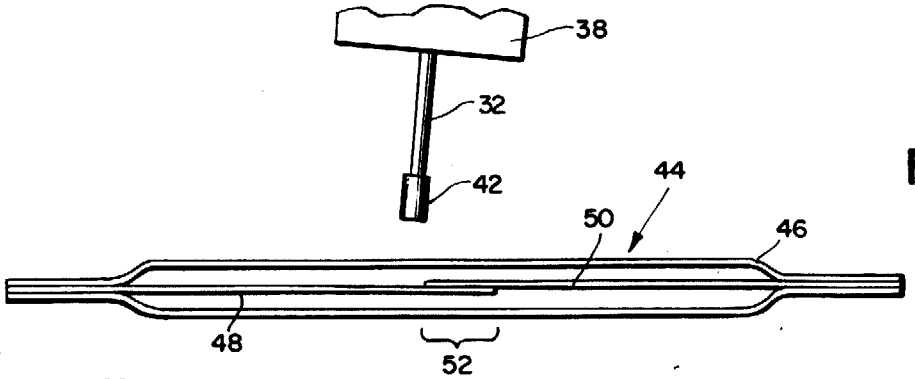
FIG. 3 is an enlarged partial schematic view of portions of the sensor arrangement of the invention.

As may be evidenced from the drawing, contacts 48 and 50 uniquely are separated to define an open circuit when vertical magnet 42 is oriented, as shown, directly over region 52. This mutual identically polarized condition of the contacts providing for their open circuit orientation is occasioned by the relatively close proximity of only one, the lower, pole of magnet 42 to the ferrous metal mass represented by those end or overlapping portions of the contacts within region 52. In the presence of an actuating impulse or movement, the orientation of magnet 42 will respect to switch region 52 is altered, for instance, to the orientation represented in FIG. 3. Here, the magnetic flux influence upon switch 44 alters to establish opposing magnetic poles at the respective end portions of contacts 48 and 50 within region 52. As a consequence, the switch rapidly reacts to close as illustrated.

In general, the above-described actuating alteration of the open contact condition of switch 44 is occasioned by a relative motion of the switch itself with respect to magnet 42. This relative movement results from an inertial tendency of the body of mass 38, and, consequently, magnet 42 to remain at rest while impulse generated motion is imparted to switch 44. Note in this regard, that switch 44 is fixed with respect to compartment 30 which, in turn, is fixed within container 14, fixedly attached, in turn, to door 12 (FIG. 1). Of course, following the above-detailed rapid initial switch actuation, rod 32 will tend to swing, thereby causing subsequent additional switch actuations. As is described in detail hereinafter, the initial actuation of switch 44 will cause the setting off of an alarm.

The sensitivity of the sensor arrangement shown is advantageously and simply adjustable by the operator. For example, a lower sensitivity may be provided by raising cylindrical mass 38 upon rod 32. Conversely, higher degrees of sensitivity are effected by simply lowering mass 38 to a selected position closer to magnet 42. Such adjustments may be provided, for instance, to accommodate the alarm device to function properly in the presence of environmental vibrations or the like which otherwise might occasion false alarms.

In addition to a uniquely responsive alarm switching or tripping function being provided by the above-described inertial sensing arrangement, an important, additional operational function is achieved. The overlapping portions of contacts 48 and 50 at region 52 constitute a region of relatively higher ferrous metal mass. Accordingly, vertically oriented magnet 42 is continually biased to orient itself over that region, in effect, a null point being developed thereat. Once the rod 32-magnet 42 assembly is disturbed to assume a swinging motion, it will tend to self-null at region 52. In consequence of this nulling reaction, sensor 44 will reset itself within an advantageously shorter interval and impart a valuable stability to the sensing system. As a further advantage, the entire basic unit 10 may be mounted upon a door 12 or the like with greater ease. The requisite null orientation of the rod 32-magnet 42 assembly will be effected without recourse to elaborate alignment procedures during the mounting of unit 10. For instance, a minor misalignment on the part of the operator is acceptable due to the attraction between the lower pole of magnet 42 and the ferrous metal mass at region 52.

The inertial sensing arrangement of the invention may assume a variety of configurations, however, that preferred has been described above in connection with FIGS. 1–3. As an example of another configuration, rod 32 may be formed of a resilient material, i.e., piano wire or the like, and fixedly mounted to a wall of the unit housing in cantilever fashion. As in the preferred embodiment, a permanent bar magnet would be attached to the free end of such rod so as to be juxtaposed to a region as at 52 of a reed or suitable magnetically actuated switch. Additionally, such switch may be mounted upon the rod 32 or the like, while the magnet is fixed to the unit housing.

Figure 4:
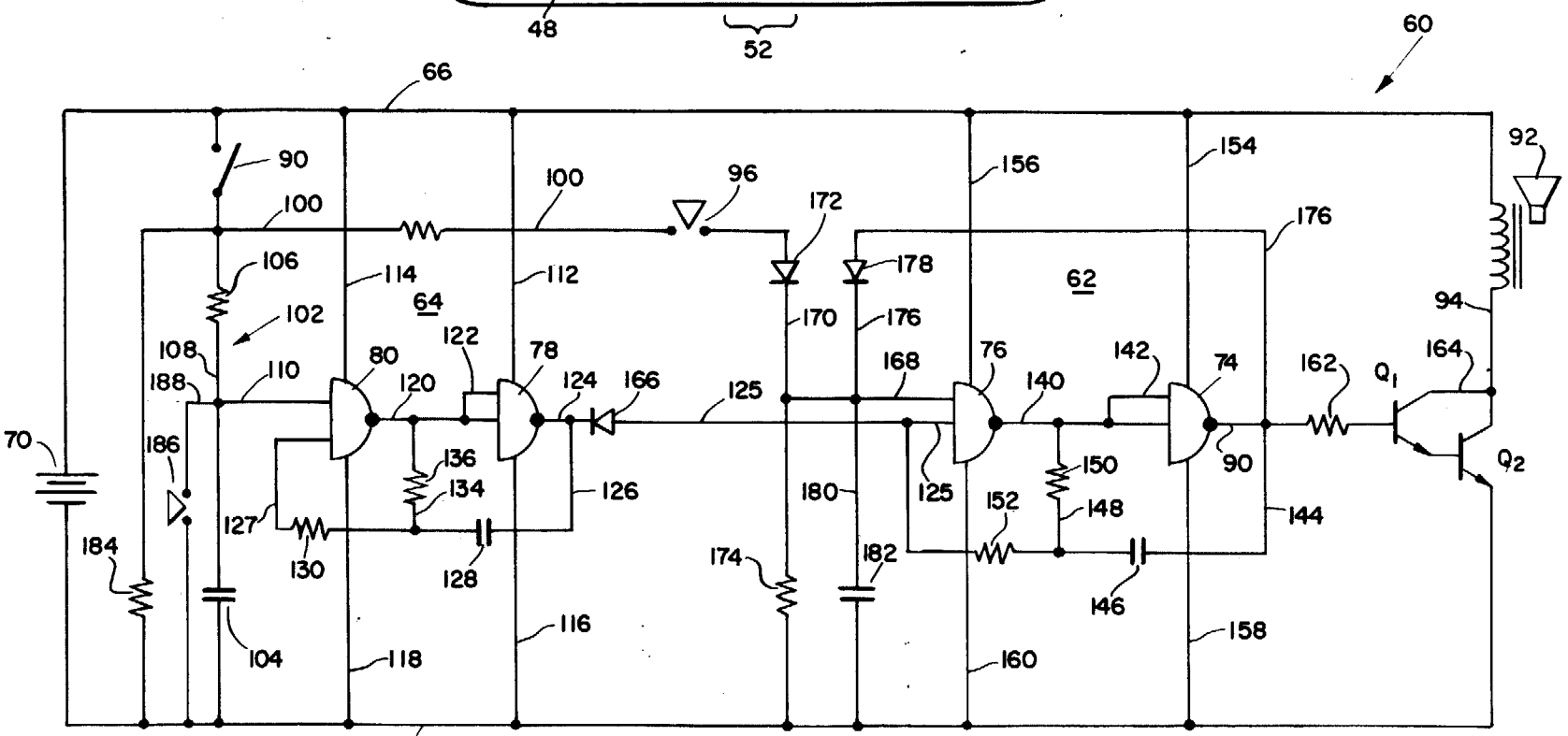
FIG. 4 is a schematic drawing of the logic circuit of the invention.

Turning to FIG. 4, a circuit intended for incorporation within unit 10 and operable in complement with sensor assembly 22 is revealed. Shown generally at 60, this circuit includes two oscillator networks 62 and 64 coupled between principal power leads 66 and 68, a battery power supply 70 and a PM speaker 92. Networks 62 and 64 incorporate four NAND gate components 74–80, for example, of A COS/MOS variety. As such, the gates exhibit very little power drain when the circuit is in a quiescent state to permit the utilization of small, compact conventional primary batteries as power source 70 for reasonably lengthy service intervals. FIG. 5 is a truth table provided to more clearly illustrate the performance of these components, Boolean enumeration being utilized to designate their operational states. For purposes of understanding these tabulations, as well as to facilitate the description to follow, when the inputs or outputs of identified components are at a ground or appropriately pass a corresponding reference potential, they are referred to as "low" and, additionally, such input or output may be digitally identified as "0". Conversely, when these inputs or outputs assume or approach the voltage status of the power supply, they are referred to as being "high" and are given the binary designation "1". NAND logic, as utilized herein, requires the presence of a 1 level at all inputs to a given gate to derive an 0 output level. Any combination of 0's or 0 at a NAND gate input will provide a 1 level output.

Other components of the circuit mentioned earlier herein include the arm switch 16, now represented by switch symbol 90, PM loudspeaker 92 located between lines 66 and 94, and sensor switch 96 within line 100 representing reed switch 44 described earlier herein.

With the closure of arm switch 90, the enabling logic of the circuit is activated by the energization of line 100. Such energization activates an R-C timing network 102 including timing capacitor 104 and timing resistor 106, appropriately located within line 108 between lines 100 and 68. Line 108 of network 102 is coupled, from a point intermediate resistor 106 and capacitor 104, to input line 110 of gate 80. Accordingly, with the arrangement shown, input line 110 is maintained at a low state both prior to the closure of switch 90 and during the timing interval determined by the time constant of network 102. Components 104 and 106 are selected to establish the above-described arming delay interval permitting sensor assembly 22 to achieve a null or quiescent condition. This interval may be selected, for example, as about 40 seconds. Prior to the noted closure of switch 90, as well as during the above-described "arm delay" interval, the states of appropriate input and output lines for gates 74–80 are listed in FIG. 5 at those lines designated "Operational Event" Numbers 1 and 2. It will become apparent as the description unfolds that any opening or closing of sensor switch 96 during these operational events will not occasion a tripping of the alarm device and consequent activation of loudspeaker 92.

As is depicted in FIG. 5, upon the occurrance of Operational Event No. 3, at the termination of the arm delay interval, input line 110 reaches a high logic level serving the purpose of arming the control system by activating oscillator network 64. NAND gates 78 and 80 of network 64 are linked to provide an astable multivibrator circuit having a sub-audio range output frequency selected to derive the pulsating, on and off, alarm feature of the system. Such pulsation frequency serves to maximize operator response to an alarm and may, for example, be selected in the 1–5 cycles-per-second range. A 4–5 C.P.S. range is preferred to achieve peak human audio response. Gates 78 and 80 are coupled for power input from principal lead 66, respectively, through lines 112 and 114, and are connected with principal lead 68, respectively, through lines 116 and 118. The output of gate 80 is coupled through lines 120 and 122 to each of the two inputs of gate 78, while the output at line 124 of gate 78 is connected through line 126, capacitor 128 and a stabilizing resistor 130 to the second input of gate 80. The coupling of resistor 130 with the noted gate 80 input is represented by the number 127 to facilitate the description to follow. A line 134, incorporating resistor 136, connects output line 120 with one side of capacitor 128 through line 126. Network 64 thus being configured, the arm condition high input to gate 80 at line 110 and corresponding high input at line 127, as disclosed at Operational Event No. 3, causes output line 120 to assume a low state. The consequent dual low input through lines 120 and 122 to gate 78 provides the noted high output thereof at line 124. Note that the voltage at the junction of lines 126 and 134 is now at its most positive value with respect to line 68, i.e. ground. Resistor 136, serving as a timing resistor in conjunction with capacitor 128, is connected through the output of gate 80 which is low, to provide a path to ground, i.e. through line 118. As capacitor 128 discharges, the voltage at the junction of lines 126 and 134 approaches and passes through the transfer-voltage point of gate 80. At the instant that this crossover occurs, the output of gate 80 at line 120 becomes high; as a result, the output at line 124 of gate 78 becomes low and capacitor 128 now is charged in the reverse direction, negatively or low. Note that the voltage at the junction of lines 126 and 134 is now at its most negative value with respect to line 68 (ground). This activity is represented as Operational Event No. 4 (Arm State B) of FIG. 5. Resistor 136, connected to the output of gate 80, now provides a path to charge capacitor 128 through line 114. Capacitor 128 begins to charge to this voltage. Again, the voltage approaches and passes through the transfer-voltage point of gate 80. At that instant, the outputs of gates 78 and 80 revert, output line 120 becoming low and output line 124 becoming high. The consequence of this oscillation is represnted at Operational Event No. 5 (Arm State A) in FIG. 5. Without further signal or logic input, the Arm State A (Operational Event No. 4) — Arm State B (Operational Event No. 5) cycle repeats at the described lower frequency. Note that capacitor 128 also is coupled through stabilizing resistor 130 to an input of gate 80. This resistor, participating in the alteration of logic levels at line 124, reduces the variations of the frequency of oscillation of network 64 that normally would occur with supply voltage variation.

By utilizing, for instance, COS/MOS integrated circuit components within networks 64 and 62, the power drain of the system is very low, i.e. in the nanowatt range as long as the output of gate 74 at line 90 remains low.

Oscillator Network 62 is formed having the same general configuration as network 64. For instance, the output at line 140 of NAND gate 76 is coupled in combination with line 142 to the inputs of NAND gate 74. Additionally, the output at line 90 of gate 74 is connected through line 144, capacitor 146, line 148 and resistor 150 to line 140. Line 144 further connects capacitor 146 to gate 76 input line 125 through a stabilizing resistor 152. Connection of gates 74 and 76 with power lead 66 is provided, respectively, by lines 154 and 156, while corresponding connection with lead 68 is provided, respectively, by lines 158 and 160. While operating in essentially the same fashion as network 64, the astable multivibrator circuit of network 62 provides an oscillatory output at line 90 selected to operate PM loudspeaker 92 at a frequency effecting peak human audio response. This frequency, determined by the resistance and capacitance, respectively, of resistor 150 and capacitor 146, preferably is selected between 1 to 4 $KH_z$.

Control over the operation of loudspeaker 92 is derived from output line 90 of gate 74 which is connected through resistor 162 to the base of the input transistor $Q_1$, of Darlington paired NPN transistors $Q_1$ and $Q_2$. Note that the collector of transistor $Q_1$ is connected through line 164 to line 94, while that of transistor $Q_2$ is directly coupled to line 94. The emitter of transistor $Q_1$ is coupled to the base of transistor $Q_2$, while the emitter of the latter is connected to lead 68. Thus configured, with the presence of a high at line 90, transistors $Q_1$ and $Q_2$ are forwardly biased to turn on and energize loudspeaker 94. Such energizations, as discussed above, will occur at the selected frequency of the output at line 90 of Network 62. Additionally, this higher frequency output will be present at the overriding frequency interval derived at the output of network 64. Accordingly, a desired on and off warning arrangement is provided for alerting the operator.

It should be observed that the control system provides an alarm signal at two frequencies, each selected in accordance with the invention, to provide maximized human audio recognition, i.e. the output frequency of network 64 is selected for lower frequency peak recognition while the output of network 62 is selected for higher frequency peak recognition.

Looking now to the operational association between networks 62 and 64, note that lines 124 and 125 connect the output of gate 78 through steering diode 166 to an input of gate 76. This input to gate 76 will be seen to be low when the output of gate 78 is low and will otherwise retain the state high or low associated with the condition of network 62. The other input to gate 76 is present at line 168 which, in turn, is coupled through line 170 and diode 172 to sensor switch 96 and to lead 68 through resistor 174. Line 168 also is coupled with a line 176, incorporating a diode 178 and extending to output line 90. Oppositely disposed from line 176 and coupled between line 168 and lead 68 is a line 180 incorporating a capacitor 182.

Actuation of network 62 to effect the driving of loudspeaker 92 will depend upon the simultaneous logic states at lines 168 and 125. Assuming that the system is armed, network 64 will be in a low frequency oscillatory mode, as described above in connection with Operational Event Numbers 4 and 5. During the armed condition of the system, as represented by "Arm States" A and B, the output line 140 of gate 76 is maintained in a high status to, in turn, maintain a low output at line 90 of gate 74. This is occasioned by the arrangement wherein line 168 is maintained at a low value, particularly, by virtue of its coupling through line 170 and resistor 174 to ground potential lead 68. During this system condition, input line 125 may vary between high and low values. Note for instance, that the high value at line 140 is introduced through resistor 150 and line 148 as well as resistor 152 to line 125. Resistor 152 is selected having a significantly higher value of resistance than that of resistor 150 and the resistance to ground of gate 78 when in a low condition. When line 124 is at a low state, line 125 will follow it, inasmuch as the gate-to-ground impedance at gate 78 is of much lower value than that at resistor 152. Conversely, when the output at line 124 of gate 78 is high, diode 166 is back-biased and the resultant high value present at lines 140 and 148 is imposed at line 125 through resistor 152. Accordingly, output line 140 is maintained at a necessary high state during this armed period of operation.

Should sensing switch 96 close under the Arm State A gate status represented by Operational Event No. 5, current will be permitted to flow through line 100, diode 172, lines 170, 168 and 180 to charge a capacitor 182. Such charging takes place very rapidly, for instance, within an interval of 0.2 ms., to establish a high state at input line 168. Inasmuch as line 125 is at a high level, output line 140 of gate 76 becomes low. In turn, the output at line 90 of gate 74 becomes high to turn on the Darlington connected transistors $Q_1$ and $Q_2$, thereby initially activating loudspeaker 92. Assuming that switch 96 opens very rapidly following initial closure, the high value at line 168 will be maintained by virtue of the time interval required to otherwise discharge capacitor 182 through lines 180, 168, 170 and resistor 174. This interval of maintaining the high status at line 168 continues for a period of time sufficient for output line 124 of gate 78 to regain a high value from a previous oscillative low and, therefore, a high value at line 125. Note that the condition of gate inputs and outputs at the point of actuation of switch 96 is represented as Operational Event No. 6 in FIG. 5.

As is apparent, oscillation of network 62 takes place only during Arm State A, as represented at Operational Event No. 5.

Looking to Operational Event No. 7, the state of the gates of the circuit are represented during an oscillation of network 62 to effect actuation of loudspeaker 92. The development of a high level at output line 90 of gate 74 is returned via line 176 and diode 178 to re-establish a charge at capacitor 182 and, in effect, hold a high state at input line 168. Accordingly, even though sensor switch 96 may be opened, network 62 will continue to oscillate. Note in this regard, that input line 125 will oscillate between high and low states in the same fashion as described in connection with line 127 of network 64. This oscillation of network 62 continues as long as Arm State A is present. Upon return of the circuit to Arm State B, as dictated by the oscillative frequency of network 64, line 125 will return to a low value to, in turn, return output 90 to a low state, thereby switching off Darlington connected transistors $Q_1$ and $Q_2$. Loudspeaker 92 is held off for the pulse interval established by network 64. Of course, upon a return of the system to Arm State A, network 62 again will commense to oscillate at the higher frequency value. It may be observed from the foregoing that sensor switch 96 need be closed only for a short interval of time to trigger the system into an alarm state. No sensor switch tending techniques utilizing SCR clamping arrangements or the like are required.

As described earlier, should arm switch 90 be opened in the course of operation of the alarm, i.e. during the pulsating drive of loudspeaker 92, the input and output logic of the gates of the circuit will assume the states depicted at Operational Event No. 8. Note from that event number, that initial opening of the switch 90 will have no effect upon the input and output states of the gates of the circuit. This condition obtains since capacitor 104, being charged, will hold input line 110 at a high state until such time as it is discharged through resistors 106 and 184. This discharge takes place over a selected interval, for instance, about one minute, at the termination of which the transistion level at line 110 drops to establish a low value. In consequence, network 64 is shut down to, in turn, effect a shutting down of network 62 to terminate alarm activity. The state of the inputs and outputs of the gates for this condition is represented at Operational Event No. 9 in FIG. 5. Turning now to a normal shutdown operation, arm switch 90 most frequently will be opened under conditions of either Arm States A or B, and prior to any closure of sensor switch 96. Upon such switch 90 opening, line 100 immediately will drop to a voltage value established by the ratio of the resistances of resistors 106 and 184. In this regard, the resistance value for resistor 106 is selected as being higher than that of resistor 184 to the extent that, upon an opening of switch 90, line 100 assumes an effective low value. As is apparent, it is now impossible to obtain a high value at line 168 even with a closure of sensor switch 96. Therefore, initiation of oscillation of network 62 is prevented.

An externally derived disarming technique is available for the circuit of the invention. For instance, a disarming arrangement requiring only a momentary actuating operation is represented by a switch 186 present within line 188 between line 110 and lead 68. Upon momentary closure of switch 186, line 110 will assume a low state to, in turn, deactivate circuit 64 and impress a steady state low on line 125. As described above, a low at line 125 prevents oscillation of circuit 62 even with a closure of switch 96. This low is maintained following reopening of switch 186 until capacitor 104 has regained sufficient charge through resistor 106 and switch 90 to return line 110 to a high value and, therefore, re-establish oscillation of circuit 64.

It is apparent that if switch 90 is opened prior to line 110 achieving a high value, that oscillation of network 64 is prevented, and the system is completely shut down. Conversely, if switch 90 is not opened, the circuit will return to its armed state after a delay period. A remotely derived momentary closure of switch 186 would therefore allow the operator to gain entry through door 12 without setting off alarm unit 10 and with the system automatically becoming re-armed or completely shut down, depending upon operator selection of the state of arm switch 90 after entry is accomplished. Numerous techniques are available for remotely effecting the opening of switch 186, for instance, the switch may be present in the circuit as a reed switch as described at 44 in conjunction with FIGS. 2 and 3. By accurately positioning a permanent magnet with respect to the switch, it will be remotely actuated to provide a disarm service. This positioning may, for instance, be made at the surface of door 12 opposite that upon which unit 10 is mounted (FIG. 1).

Since certain changes may be made in the above described apparatus and system without departing from the scope of the invention herein involved, it is intended that all matter contained in the above description or shown in the accompanying drawings shall be interpreted as illustrative and not in a limiting sense.

I claim:

1. An inertially responsive sensor for sensing an impact or motion generating phenomena imparted to a housing comprising:

a body of predetermined mass;

supporting means for flexibly supporting said body a selected distance from a given position upon said housing and configured to permit said body to move to attain a state of rest; and switch means having at least two components including a magnetically actuable switching device and a magnet one of said components being fixedly mounted upon said housing, the other of said components being mounted upon said supporting means and movable therewith, said switching device being configured comprising at least two ferromagnetic material switch contact members which extend, from mutually spaced supportive locations to overlap within a region for mutual contact thereof, said region thereby exhibiting an enhanced quantity of said ferromagnetic material with respect to regions of said switching device immediately adjacent thereto, said magnet being mounted for asserting a magnetic influence of only one polar sense and with said switch device switch contact overlap region, said component mounting being arranged such that the magnetic attraction between said switch contact overlap region and said magnet effects a bias for said supporting means to move to attain a stable state of positional adjacency between said magnet and said region, said body attaining said state of rest in correspondence with said attainment of said stable state, induced relative movement between said components wherein said magnetic influence is asserted outwardly of said region effecting a magnetic actuation of said switching device to provide a sensing output.

2. The inertially responsive sensor of claim 1 in which said body of predetermined mass and said supporting means are mutually configured for adjustably changing said selected distance of said body from said given position upon said housing.

3. The inertially responsive sensor of claim 1 in which said body of predetermined mass and said supporting means are mutually configured to define a pendulum pivotally suspended from said given position upon said housing.

4. The inertially responsive sensor of claim 1 in which said magnet is mounted upon and movable with said supporting means; and said switching device is mounted upon said housing in a location simultaneously promoting said stable state of positional adjacency and said state of rest, said switching device having an open switching condition when said positional adjacency is attained and is actuable to assume a closed switching condition upon said relative movement between said components.

5. The inertially responsive sensor of claim 4 in which said switching device is a reed relay switch, and said magnet is a permanent bar magnet mounted upon said supporting means at an extremity thereof oppositely disposed from said given position and extending therefrom to derive a unipolar said magnetic influence with said switch contact overlap region.

6. An inertially responsive sensor for sensing an impact or motion generating phenomena imparted to a housing comprising:

an elongate support having one end extending from a position of connection with said housing and an end opposite thereto movable to attain a state of rest;

a magnet fixed to said support opposite end and arranged thereupon in a manner wherein only one pole thereof extends from said opposite end; and a magnetically actuable switch configured comprising at least two ferromagnetic material switch contact members which extend from spaced supportive locations to overlap at a region for selectively providing a circuit completing mutual contact thereof, said region thereby exhibiting a quantity of said ferromagnetic material with respect to regions immediately adjacent thereto, said switch being mounted upon said housing at a location wherein said one magnet pole is adjacent said contact member overlap region when said support is in said state of rest, whereby said contact members are mutually magnetically repelled to exhibit an open circuit condition when said magnet pole is adjacent said overlap region and are mutually magnetically attracted to a closed circuit condition upon the occurrence of a said phenomena effecting relative displacement of said magnet pole and said switch wherein said magnet pole is located outwardly of said contact member overlap region.

7. The inertially responsive sensor of claim 6 including a member of predetermined weight connectible with said support at a select location intermediate said one end and said opposite end, said weight and said location being selected for regulating the inertial sensitivity of said support to said phenomena.

8. The inertially responsive sensor of claim 6 in which said support is pivotally connected with said housing to effect a pendulum suspension of said magnet from said position of connection.

9. The inertially responsive sensor of claim 8 including a member of predetermined weight connectible with said support at a select location intermediate said one end and said opposite end, said weight and said location being selected for regulating the inertial sensitivity of said support to said phenomena.

10. The inertially responsive sensor of claim 9 in which said switch is a reed relay switch; and said magnet is a permanent bar magnet.

* * * * *